US006519348B1

(12) United States Patent
Ikeuchi et al.

(10) Patent No.: US 6,519,348 B1
(45) Date of Patent: Feb. 11, 2003

(54) SPEAKER APPARATUS AND TELEVISION SET

(75) Inventors: Kazuhiko Ikeuchi, Takatsuki (JP); Tomio Shiota, Takatsuki (JP); Seiji Harada, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/701,279

(22) PCT Filed: May 24, 1999

(86) PCT No.: PCT/JP99/02714

§ 371 (c)(1),
(2), (4) Date: Nov. 28, 2000

(87) PCT Pub. No.: WO99/62293

PCT Pub. Date: Dec. 2, 1999

(30) Foreign Application Priority Data

May 28, 1998 (JP) ..... 10-147783

(51) Int. Cl.[7] ..... H04R 1/02; H04R 1/20

(52) U.S. Cl. ..... 381/340; 181/175; 181/152; 181/177

(58) Field of Search ..... 381/340, 341, 381/342, 343, 114, 333, 339, 338, 347, 348; 181/151, 152, 159, 177, 178, 192, 180

(56) References Cited

U.S. PATENT DOCUMENTS

| | | | | |
|---|---|---|---|---|
| 4,206,831 A | | 6/1980 | Welch et al. | |
| 4,469,921 A | * | 9/1984 | Kinoshita | 181/187 |
| 5,020,630 A | * | 6/1991 | Gunness | 181/192 |
| 5,432,860 A | * | 7/1995 | Kasjima et al. | 381/156 |
| 6,028,947 A | * | 2/2000 | Faraone et al. | 381/340 |
| 6,059,069 A | * | 5/2000 | Hughes, III | 181/152 |
| 6,094,495 A | * | 7/2000 | Rocha | 381/340 |
| 6,118,883 A | * | 9/2000 | Rocha | 381/387 |
| 6,343,133 B1 | * | 1/2002 | Adamson | 381/340 |
| 6,343,134 B1 | * | 1/2002 | Czerwinski | 381/342 |

FOREIGN PATENT DOCUMENTS

| | | |
|---|---|---|
| EP | 0 598 391 | 5/1994 |
| FR | 2 558 290 | 7/1985 |
| GB | 2 312 587 | 10/1997 |
| JP | 5-20475 | 3/1993 |
| JP | 5-236583 | 9/1993 |
| JP | 5-236585 | 9/1993 |
| JP | 6-303553 | 10/1994 |
| JP | 7-177443 | 7/1995 |

* cited by examiner

*Primary Examiner*—Rexford N. Barnie
(74) *Attorney, Agent, or Firm*—Wenderoth, Lind & Ponack, L.L.P.

(57) ABSTRACT

A first feature of the present invention is that the opening of a sound output port 3*b* is smaller in area than the opening of a sound input port 3*a* in a horn 3. A second feature is that the sound output port 3*b* of the horn 3 is located so as not to be in the way of a center axis of sound radiation from a speaker 2. A third feature is that a length L of the horn 3 is set at 370 mm or below. A fourth feature is that the horn 3 is gradually narrowed such that vertical sections thereof from the sound input port 3*a* to the sound output port 3*b* respectively have areas based on a predetermined rule.

Thus, it is possible to realize a speaker apparatus in which a sound output port of a horn is smaller in area than a vibrating surface of a speaker while reproducing sound whose quality is equal or similar to that in conventional speaker apparatus, and a television set equipped with the speaker apparatus.

7 Claims, 6 Drawing Sheets

SPEAKER APPARATUS AND TELEVISION SET

TECHNICAL FIELD

The present invention relates to speaker apparatus and television sets, and more specifically to a speaker apparatus provided with a horn having an output port smaller in area than a vibrating surface of a speaker, and a television set equipped with the speaker apparatus.

BACKGROUND ART

In general, it is the best that a speaker apparatus directly outputs sound from a speaker without utilizing a horn. A horn, however, is commonly used in a speaker apparatus because of the limited size of a cabinet such as a television set and personal computer where the speaker apparatus is installed.

For example, in the case where a speaker apparatus is integrated in a television set and then speakers are placed on both sides of a cathode ray tube (CRT) thereof , the width of the television set is uselessly enlarged. Therefore, in a conventional television set, a speaker apparatus provided with a horn having a slim and long output port is widely used to minimize the width of the television set.

Such speaker apparatus provided with horns having slim and long output ports include, for example, "Speaker system for television set" disclosed in Japanese Utility Model Publication No. 5-20475, and "Speaker system for television set" disclosed in Japanese Patent Laying-Open No. 7-177443.

In FIG. 7, shown is a perspective view of "Speaker system for television set" disclosed in Japanese Patent Laying-Open No. 7-177443.

In the above-described conventional speaker apparatus, an output port of a horn is required to be larger in area than a vibrating surface of a speaker in order to secure a sufficient sound pressure level. The configuration of the conventional speaker apparatus allows a television set to be narrower in width. However, the height of the television set must be increased due to the decreased width in order to ensure the area of the output port to be larger than the area of the vibrating surface of the speaker. Consequently, the television set has a complicated structure, and a molding die for the speaker apparatus is elaborate and expensive, which makes it difficult to produce the speaker apparatus with a multiple cavity die. Besides, the speaker apparatus occupies a large portion in the television set as a result. This leads to a problem that the structure of the television set can not be freely designed.

Therefore, an object of the present invention is to provide a speaker apparatus in which a sound output port of a horn is smaller in area than a vibrating surface of a speaker while reproducing sound whose quality is equal or similar to that in the conventional art, and a television set equipped with the speaker apparatus.

DISCLOSURE OF THE INVENTION

The present invention has the following features to attain the above-described object.

A second aspect is directed to a speaker apparatus comprising a speaker with a horn, the horn has a shape in which:

a sound input port is attached to a vibrating surface of the speaker, and a sound output port is smaller in area than the sound input port;

the length from the sound input port to the sound output port is not more than 370 mm;

when representing the area of the opening of the sound input port as A, the area of the opening of the sound output port as B, the length of the horn as L, a distance from the sound input port as X, and an arbitrary integer of not less than 1 as C, the area Y of the vertical section, of the horn, being parallel to a plane of the sound input port at the distance X can be expressed by the following equation;

$$Y=(A-B)*(L-X)^C/L^C+B; \text{ and}$$

the sound output port is formed in a position where a center axis of the sound radiated from the speaker does not impinge against an inner wall of the horn.

As described in the above, according to the second aspect, it is possible to make an opening of the sound output port smaller in area than an opening of sound input port in the horn, and at the same time, suppress resonance of sound outputted from the speaker within the horn down to its second resonance frequency and obtain better sound pressure properties as compared with the conventional speaker apparatus. As a result, preferable sound with less dip can be reproduced.

As stated above, the second aspect indicates a preferable length of the horn in the first aspect. Thus, the resonance of sound outputted from the speaker can be suppressed within the horn down to its second resonance.

According to a third aspect, in the second aspect, wherein in the predetermined rule, when representing an area of an opening of the sound input port as A, an area of an opening of the sound output port as B, a length of the horn as L, a distance from the sound intput port as X, and an arbitrary integer of not less than 1 as C, an area Y of the vertical section of the horn at the distance X can be expressed by a following equation;

$$Y=(A-B)\times(L-X)^C/L^C+B.$$

As mentioned in the foregoing, the third aspect presents a typical equation for calculating each area of the vertical sections of the horn in the second aspect.

According to a fourth aspect, in the second aspect, the shapes of the sound input port and the output port and the vertical section of the horn are any one of circular, oval, or polygonal form, or a combination of the above-described forms.

As described above, according to the second aspect, in the second aspect, it is possible to reduce unwanted sound produced by the resonance within the horn and the strength of installation structure of the horn.

According to a fifth aspect, in the fourth aspect, the opening of the sound input port of the horn is equal to or smaller in area than the vibrating surface of the speaker.

As described above, according to the fifth aspect, in the fourth aspect, it is possible to prevent sound from resonating within the horn.

According to a sixth aspect, in the fifth aspect, another horn is further provided to the output port of the horn while keeping the entire length no more than 370 mm, wherein the vertical sectional area of the another horn is constant or a sound output port thereof being broader than a sound input port thereof.

As described above, according to the sixth aspect, in the fifth aspect, the horn can be designed more flexibly.

A seventh aspect is directed to a television set equipped with the speaker apparatus according to any one of the following (a), (b) or (c):

(a) A speaker apparatus, wherein the horn has a shape in which:

a sound input port is attached to a vibrating surface of the speaker, and a sound output port portion for outputting sound inputted to the sound input port is smaller in area than the sound input port;

the length from the sound input port to the sound output port is not more than 370 mm;

when representing the area of the opening of the sound input port as A, the area of the opening of the sound output port as B, the length of the horn as L, a distance from the sound input port as X, and an arbitrary integer of not less than 1 as C, the area Y of the vertical section, of the horn, being parallel to the plane of the sound input port at the distance X can be expressed by a following equation;

$$Y=(A-B)\times(L-X)^C/L^C+B;\text{ and}$$

the sound output port is formed in a position where a center axis of the sound radiated from the speaker does not impinge against an inner wall of the horn.

(b) The speaker apparatus as described above in (a), wherein the shapes of the sound input port and the sound output port and the vertical section of the horn are any one of circular, oval, or polygonal from, or a combination of the above-described forms.

(c) The speaker apparatus as described above in (b), wherein the opening of the sound input port of the horn is equal to or smaller in area than the vibrating surface of the speaker;

wherein another horn is further provided to the output port of the horn while keeping the entire length no more than 370 mm; and wherein the vertical sectional area of the another horn is constant or a sound output port thereof being broader than a sound input port thereof.

As described above, the seventh aspect is directed to the television set equipped with the speaker apparatus described in any one of the second, fourth and sixth aspects. The television set can dispose a sound output port in empty space in the front of a cabinet thereof, and reduce the width thereof by being equipped with the speaker apparatus described in any one of the second, fourth and sixth aspects. Besides, since the structure of the speaker apparatus can be simplified, a molding die for the speaker apparatus can be also simplified. This enables production of speaker apparatus with a single multiple cavity die. Consequently, it is possible to provide greater flexibility with the design of the television set.

According to a tenth aspect, in the ninth aspect, wherein shapes of the sound input port and the sound output port and the vertical section of the horn are any one of circular, oval, or polygonal, or combination thereof.

According to an eleventh aspect, in the tenth aspect, wherein the opening of the sound input port of the horn is equal to or smaller in area than the vibrating surface of the speaker.

According to a twelfth aspect, in the eleventh aspect, wherein another horn whose vertical sectional area is constant, or broader toward a sound output port thereof is further added to the output port of the horn.

As described above, the seventh to twelfth aspects are directed to the television set equipped with the speaker apparatus according to the first to sixth aspects. The television set can dispose a sound output port in empty space in the front of a cabinet thereof, and reduce the width thereof by being equipped with the speaker apparatus according to the first to sixth aspects. Besides, since the structure of the speaker apparatus can be simplified, a molding die for the speaker apparatus can be also simplified. This enables production of speaker apparatus with a single multiple cavity die. Consequently, it is possible to provide greater flexibility with the design of the television set.

BEST MODE FOR CARRYING OUT THE INVENTION

Figure 1:
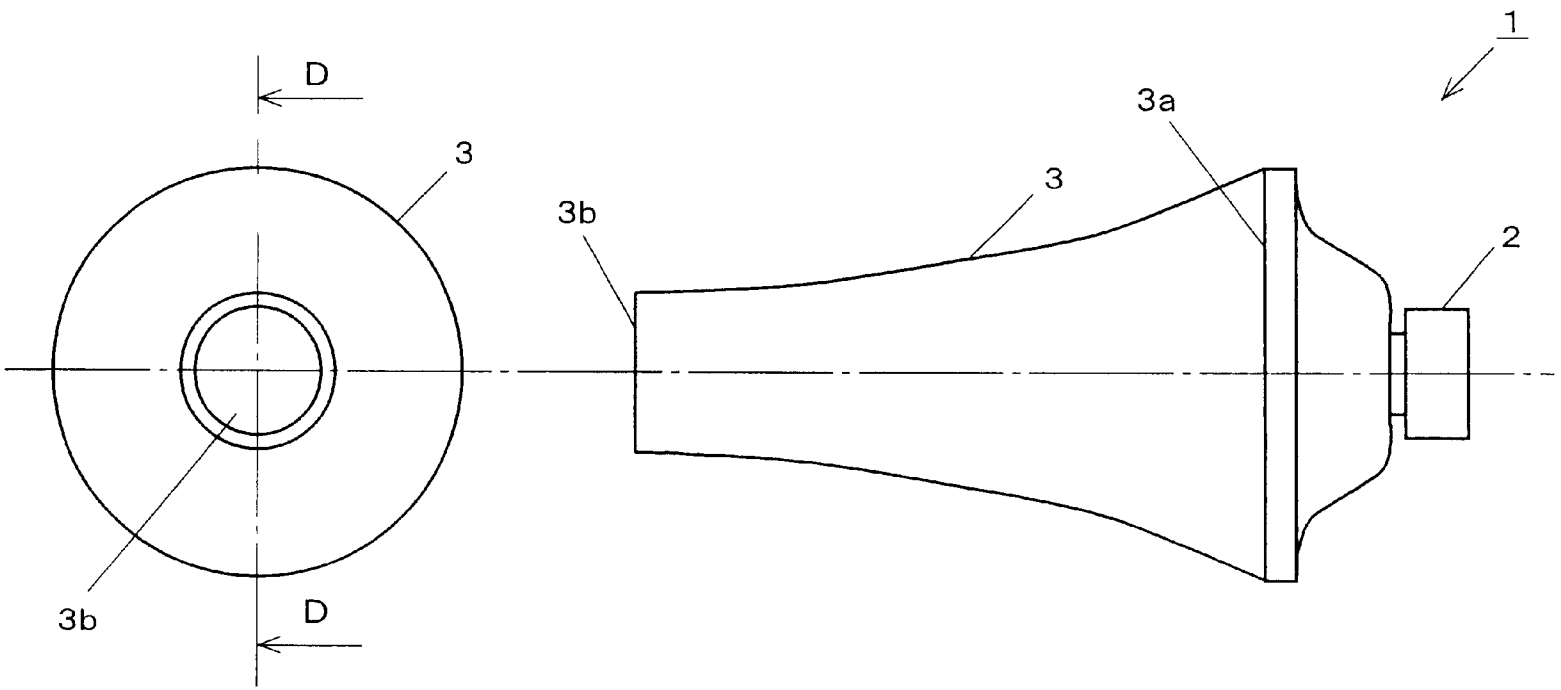
FIG. 1 is a diagram showing a structure of a speaker apparatus according to an embodiment of the present invention.

FIG. 1 shows a structure of a speaker apparatus according to an embodiment of the present invention. In FIG. 1, a speaker apparatus 1 according to the embodiment of the present invention comprises a speaker 2 and a horn 3.

Figure 2:
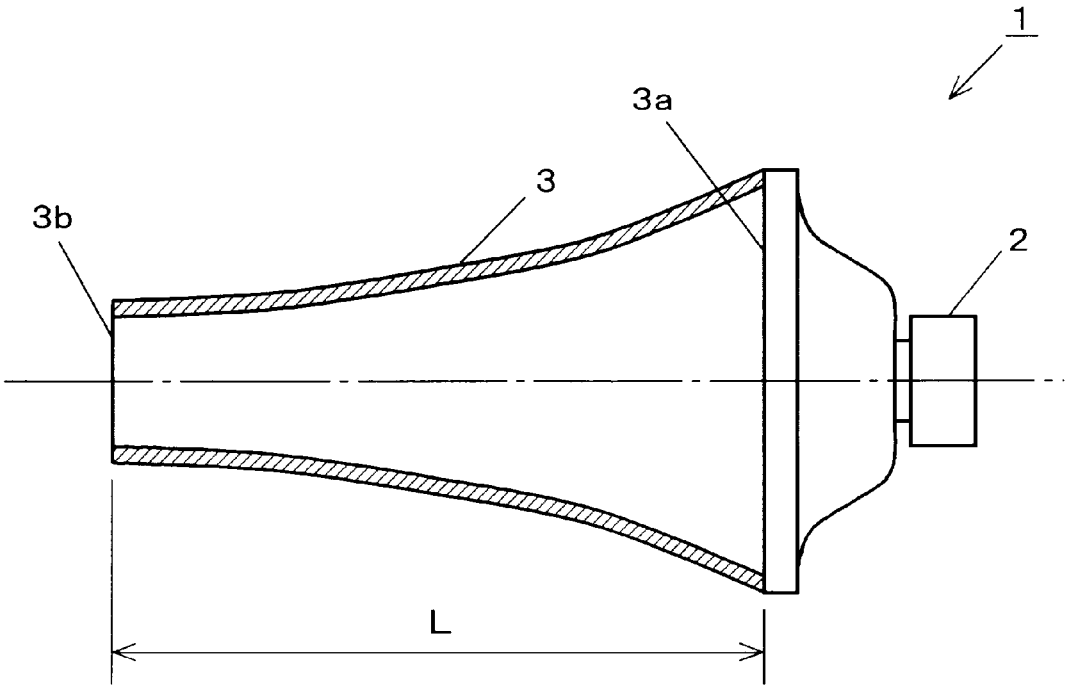
FIG. 2 is a diagram showing a section view of the speaker apparatus 1 obtained by cutting the horn 3 shown in FIG. 1 along a D—D line.

FIG. 2 shows a section view of the speaker apparatus obtained by cutting the horn 3 shown in FIG. 1 along a D—D line.

The speaker 2 is a general speaker unit having a diaphragm in a circular, oval, or rectangular shape. The horn 3 is shaped like a hollow tube as shown in FIG. 2. The horn 3 receives sound outputted from the speaker 2 with one opening end (hereinafter, referred to as a sound input port 3*a*), and outputs the sound from the other opening end (hereinafter, referred to as a sound output port 3*b*). A vertical section through the horn 3 (that is, a section parallel to a two-dimensional plane of the sound input port 3*a*) is basically in a circular shape, but may be oval or polygonal if it satisfies conditions described below.

The speaker apparatus 1 according to the embodiment of the present invention is featured by the shape of the horn 3. The shape of the horn 3 having the following features is described in sequence below with reference to FIGS. 3 to 5.

Figure 3A:
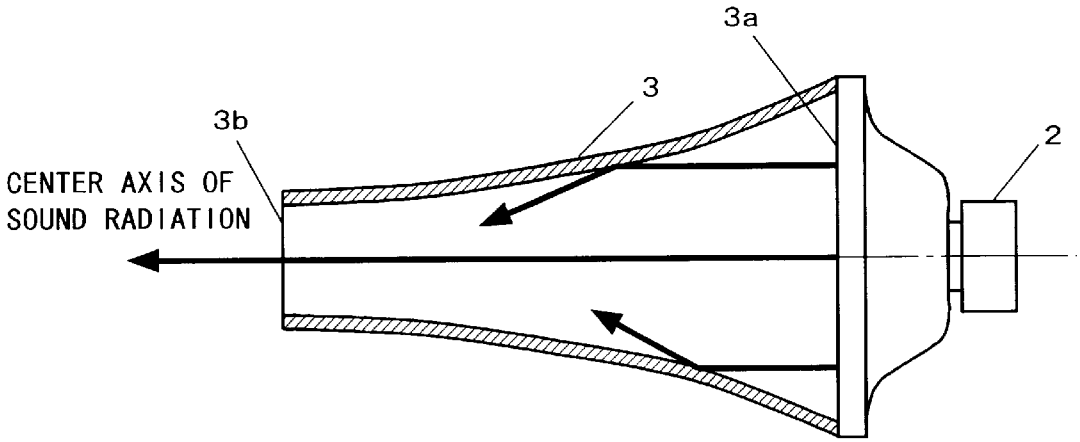
FIGS. 3A and 3B are diagrams each showing a position of the sound output port 3*b* with respect to an axis of sound radiation.
Figure 3B:
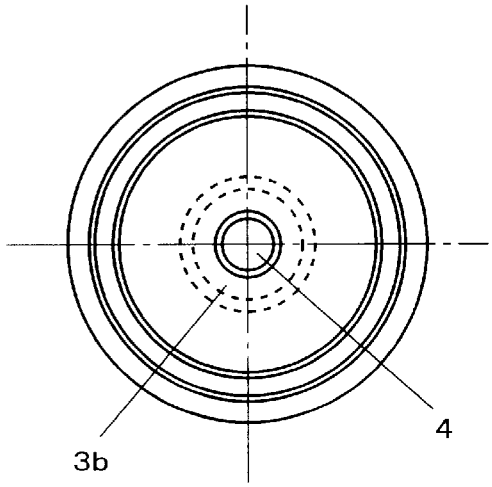
Figure 4:
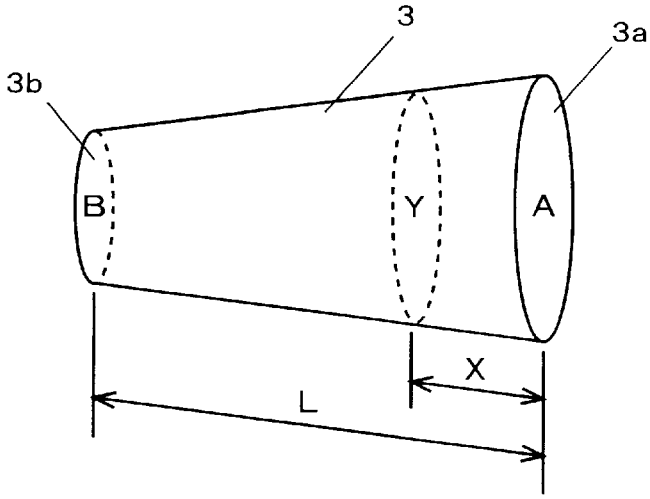
FIG. 4 is a diagram explaining a narrowing shape of the horn 3.
Figure 5:
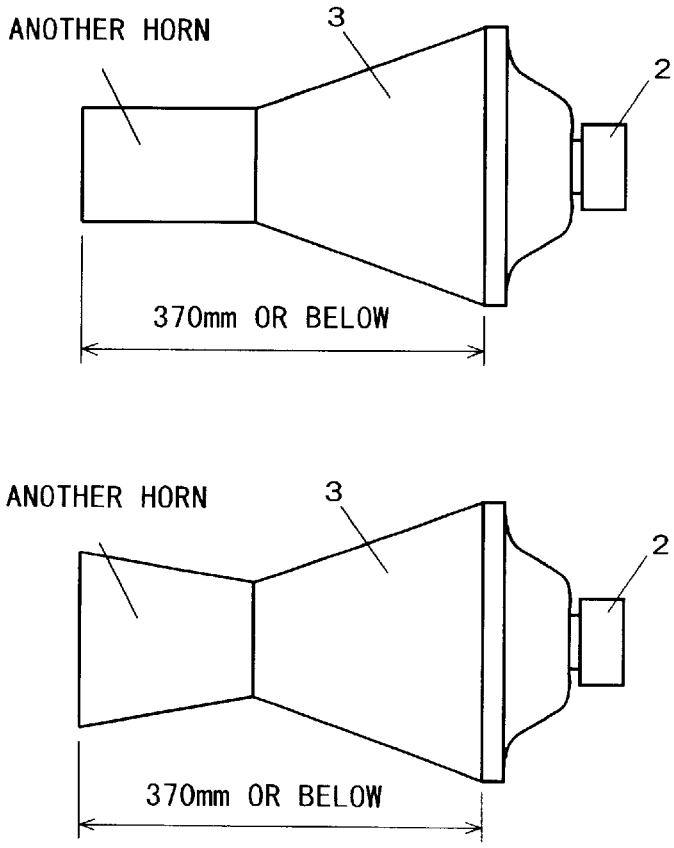
FIGS. 5A and 5B are diagrams each showing combination of the speaker apparatus 1 of the present invention and another horn.

FIGS. 3A and 3B each show a position of the sound output port 3*b* with respect to an axis of sound radiation. FIG. 4 explains a narrowing shape of the horn 3. FIGS. 5A and 5B each show combination of the speaker apparatus 1 of the present invention and another horn.

Firstly, a first feature of the shape is that in the horn 3, an opening of the sound output port 3*b* is smaller in area than an opening of the sound input port 3*a* (refer to FIG. 2).

This makes it possible to use the speaker 2 with a wide-bore regardless of the size of a cabinet accommodating the same.

Next, a second feature of the shape is that the sound output port 3*b* of the horn 3 is located so as not to be in the way of a center axis of sound radiation from the speaker 2 (refer to FIG. 3A). Specifically, the sound output port 3*b* is located in a position where a dust cap 4 formed in the center of the diaphragm of the speaker 2 can be viewed in its entirety through the sound output port 3*b* (refer to FIG. 3B).

Thus, a high-frequency sound can be directly radiated from the sound output port 3*b* through the center portion of the speaker apparatus 1, and thereby sound can be outputted without being polarized.

Next, a third feature of the shape is that a length L of the horn 3 (refer to FIG. 2) is determined such that sound properties of the speaker apparatus 1 are equal or similar to those in the speaker 2 without the horn 3. Note that the length L is preferably set at 370 mm or below. This value indicates a condition where the sound reproduction properties of the speaker apparatus 1 with the horn 3 are equal or similar to those of the single speaker 2 without the horn 3, and is obtained by experiment.

This makes it possible to suppress resonance of sound outputted from the speaker 2 within the horn 3 down to its second resonance frequency.

Furthermore, a fourth feature of the shape is that areas of vertical sections of the horn 3 from the sound input port 3*a* to the sound output port 3*b* are gradually narrowed on the basis of a predetermined rule. The predetermined rule is, for example, expressed by an equation shown bellow.

Referring to FIG. 4, when representing an area of the opening of the sound input port 3*a* as A, an area of the opening of the sound output port 3*b* as B, a length of the horn 3 as L, and a distance from the sound input port 3*a* as X, an area Y of the vertical section of the horn 3 at the distance X can be expressed as follows:

$$Y=(A-B)\times(L-X)^c/L^c+B$$

where a multiplier factor C for the distance X is a constant for deciding the narrowing shape of the horn 3, and takes an integer of not less than 1 as a value.

As is clear from the above equation, the area Y of the vertical section of the horn 3 at the distance X becomes smaller while being inversely proportional to the multiplier factor C for the distance X. For example, the area Y of the vertical section is narrowed along an inclined linear line as shown in FIG. 4 in the case where the factor C is equal to 1, and narrowed along an inclined quadric curve as shown in FIG. 1 in the case where the factor C is equal to 2.

It should be noted that the multiplier factor C can be arbitrarily set according to purposes, but is preferably set at 2 for excellent sound reproduction.

In the case where the speaker 2 has an oval or rectangular shaped diaphragm, in order to form the sound output port 3*b* of the horn 3 in a circular shape, the horn 3 may be molded by gradually deforming the vertical section thereof from the shape of the diaphragm in the sound input port 3*a* to a circular shape of the sound output port 3*b*.

As described in the foregoing, according to the speaker apparatus 1 in the embodiment of the present invention, it is possible to make the opening of the sound output port 3*b* smaller in area than the opening of the sound input port 3*a* in the horn 3, and at the same time, suppress resonance within the horn 3 and obtain better sound pressure properties as compared with conventional speaker apparatus. As a result, sound with less dip can be reproduced.

This provides greater flexibility with the design of a television set, and the like.

Moreover, it is possible to further add another horn, whose vertical section area is constant or broaden toward the sound output port, to the speaker apparatus 1 of the present invention, on condition that the total length the speaker apparatus 1 falls within 370 mm or below when the distance from the sound input port 3*a* to the sound output port 3*b* of the horn 3 is not more than 370 mm (see FIGS. 5A and 5B).

Figure 6B:
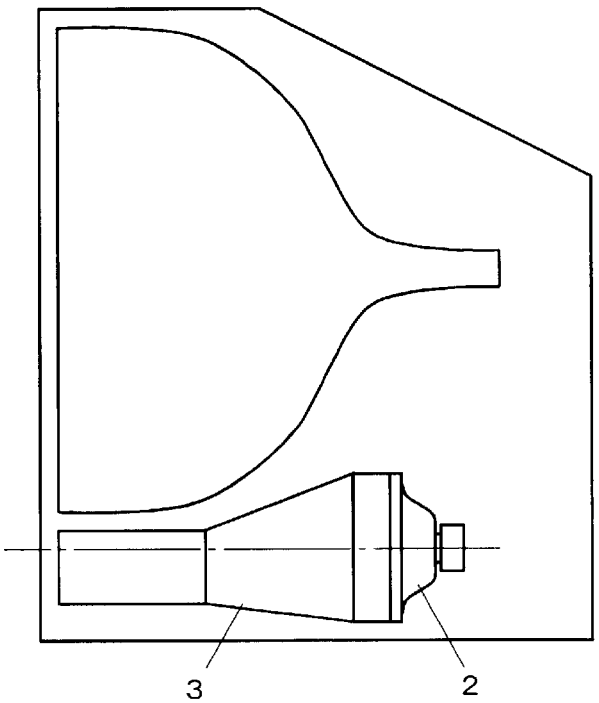
FIGS. 6A and 6B are diagrams each showing a structure of a television set equipped with the speaker apparatus 1 according to the present invention.
Figure 6A:
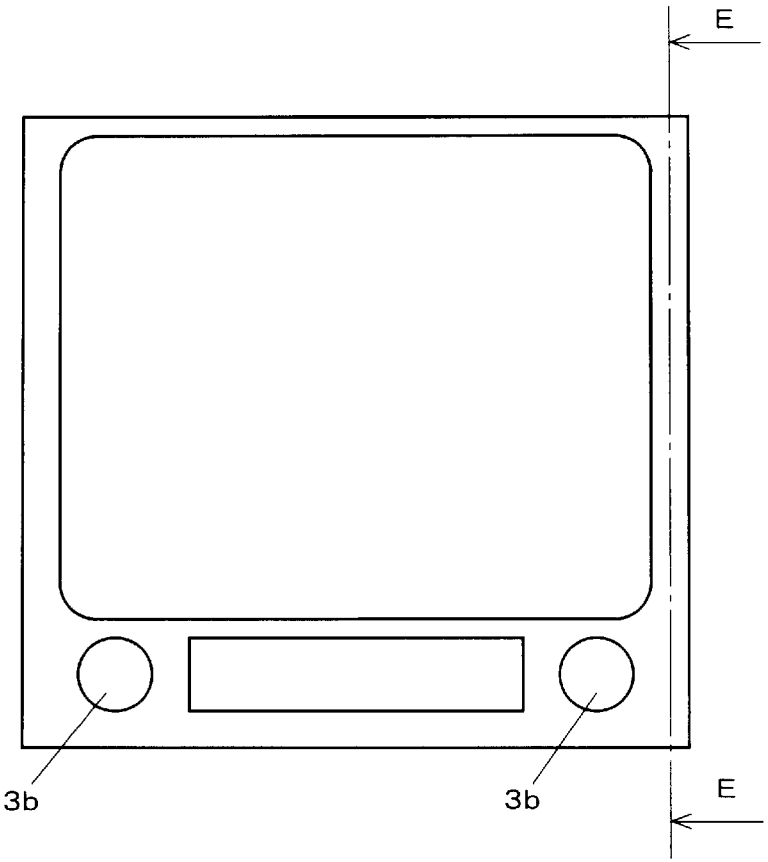
Figure 7:
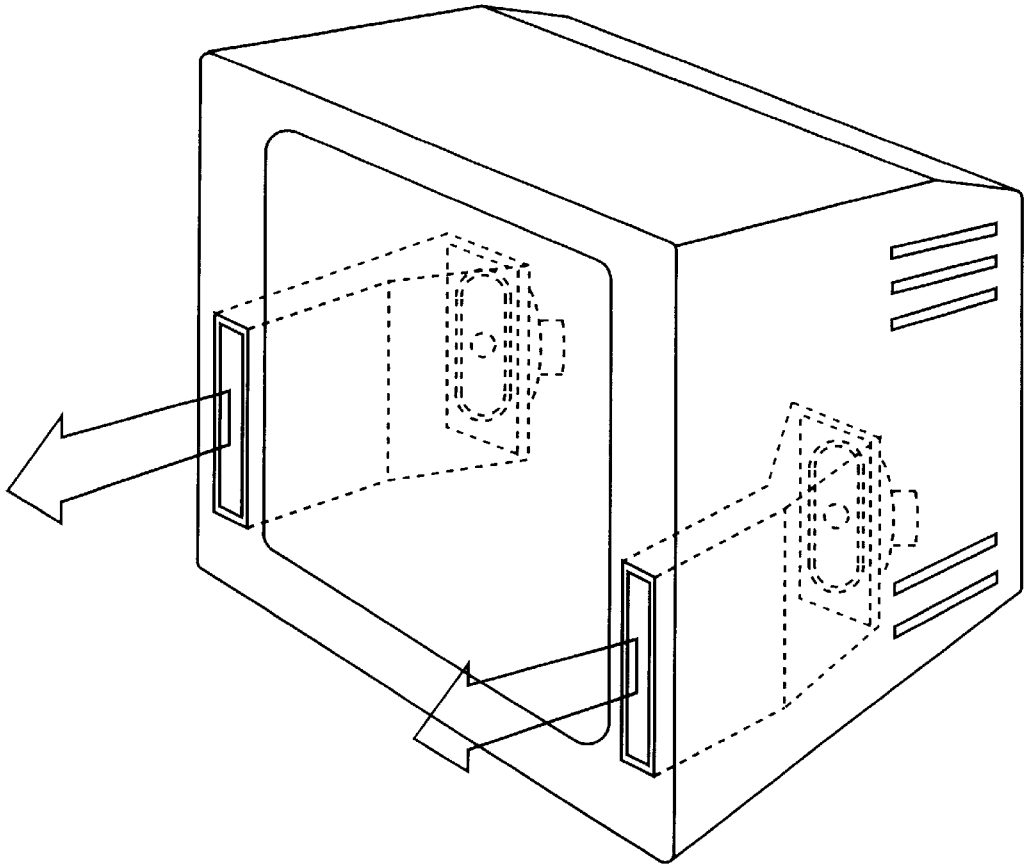
FIG. 7 is a diagram showing a structure of a television set equipped with a conventional speaker apparatus.

Shown in FIGS. 6A and 6B are television sets each equipped with the speaker apparatus 1 according to the above-mentioned embodiment of the present invention. FIG. 6A shows a front elevational view of the television set, and FIG. 6B shows a section view of the television set obtained by cutting the television set along an E—E line.

As shown in FIGS. 6A and 6B, the speaker apparatus 1 according to the above-mentioned embodiment of the present invention has another effect, in addition to the above-mentioned effects, that the sound output ports 3*b* can be disposed in empty space in a front operating panel of the television set. Thus, the television set can be downsized with respect to its width.

Furthermore, the television set shown in FIG. 6 can suppress vibration of its cabinet and use a base, on which the cabinet is mounted, as a baffle, thereby realizing preferable sound reproduction with less unwanted sound.

INDUSTRIAL APPLICABILITY

As stated above, the speaker apparatus of the present invention can be used in a television set, display apparatus, and the like. The use of the speaker apparatus makes it possible to make a sound output port in a horn smaller in area than a vibrating surface of a speaker while reproducing sound whose quality is equal or similar to that in conventional speaker apparatus.

What is claimed is:

1. A speaker apparatus comprising a speaker with a horn, said horn has a shape in which:

a sound input port is attached to a vibrating surface of said speaker, and a sound output port for outputting sound inputted to the sound input port is smaller in area than the sound input port;

the length from said sound input port to said sound output port is not more than 370 mm;

when representing the area of the opening of said sound input port as A, the area of the opening of said sound output port as B, the length of said horn as L, a distance from said sound input port as X, and an arbitrary integer of not less than 1 as C, the area Y of the vertical section, of said horn, being parallel to a plane of said sound input port at the distance X can be expressed by the following equation;

$$Y=(A-B)\times(L-X)^c/L^c+B;\text{ and}$$

said sound output port is formed in a position where a center axis of the sound radiated from said speaker does not impinge against an inner wall of said horn.

2. The speaker apparatus according to claim 1, wherein the shapes of said sound input port (3*a*) and said output port (3*b*) and said vertical section of said horn (3) are any one of circular, oval, or polygonal form, or a combination of the above described forms.

3. The speaker apparatus according to claim 2, wherein the opening of said sound input port of said horn is equal to or smaller in area than the vibrating surface of said speaker.

4. The speaker apparatus according to claim 3, wherein another horn is further provided to said output port of said horn while keeping the entire length no more than 370 mm, wherein said vertical section area of the another horn is constant or a sound output port thereof being broader than a sound input port thereof.

5. A television set equipped with the speaker apparatus as claimed in claim 1.

6. A television set equipped with the speaker apparatus as claimed in claim 2.

7. A television set equipped with the speaker apparatus as claimed in claim 4.

* * * * *